United States Patent [19]

Venaleck

[11] Patent Number: 4,772,210

[45] Date of Patent: Sep. 20, 1988

[54] ELECTRICAL CONNECTOR WITH KEYING, TORSION RESTRAINT AND LATCHING FEATURES

[75] Inventor: Howard J. Venaleck, Painesville, Ohio

[73] Assignee: Associated Enterprises, Inc., Painesville, Ohio

[21] Appl. No.: 886,308

[22] Filed: Jul. 14, 1986

[51] Int. Cl.[4] ..... H01R 9/09

[52] U.S. Cl. ..... 439/55; 439/357; 439/680

[58] Field of Search ..... 339/91 R, 17 LL, 75 MP, 339/184 R, 184 M, 186 R, 186 M; 439/350, 351, 357, 358, 79, 677, 680, 681, 55

[56] References Cited

U.S. PATENT DOCUMENTS

| | | | |
|---|---|---|---|
| 3,215,975 | 11/1965 | Kinkaid | 339/17 LC |
| 3,399,374 | 8/1968 | Pauza et al. | 339/184 M |
| 3,588,784 | 6/1971 | Kunkle et al. | 339/184 M |
| 4,030,799 | 6/1977 | Venaleck | 339/99 R |
| 4,264,114 | 4/1981 | Chandler | 339/17 LC |
| 4,299,433 | 11/1981 | Jayne | 339/91 R |
| 4,376,565 | 3/1983 | Bird et al. | 339/186 M |

FOREIGN PATENT DOCUMENTS

| | | | |
|---|---|---|---|
| 2210229 | 9/1973 | Fed. Rep. of Germany | 339/91 R |
| 2210844 | 9/1973 | Fed. Rep. of Germany | 339/91 R |

*Primary Examiner*—J. Patrick McQuade

*Attorney, Agent, or Firm*—Renner, Otto, Boisdelle & Sklar

[57] ABSTRACT

An electrical connector for connection to plural contacts mounted on a printed circuit board, other support or the like, including plural electrical contacts for engaging and electrically connecting with corresponding ones of such plural contacts, a support structure for supporting the electrical contacts, a resilient latch mechanism for maintaining the electrical connector in position with respect to such plural contacts and such printed circuit board and independently of such plural contacts, a keying mechanism to assure correct contact to contact installation and an anti-rotation mechanism cooperative with such printed circuit board to prevent rotation of the electrical connector relative thereto during installation onto such plural contacts. In a preferred embodiment the plural contacts are connected, e.g. by soldering, to the printed circuit board or to circuits thereon or associated therewith, and the anti-rotation mechanism helps to prevent applying torsion forces to such connections.

23 Claims, 2 Drawing Sheets

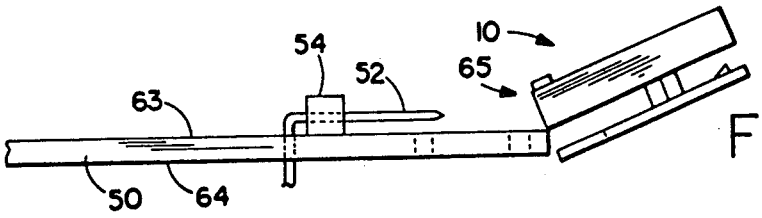
FIG. 5
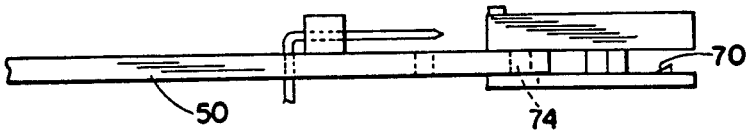
FIG. 6
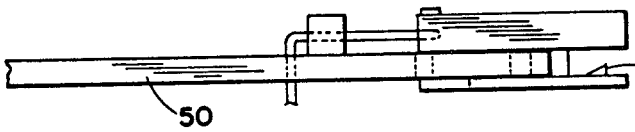
FIG. 8
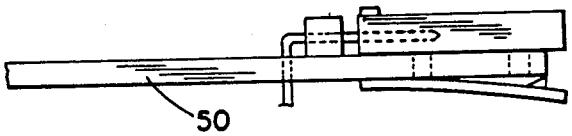
FIG. 9
FIG. 10
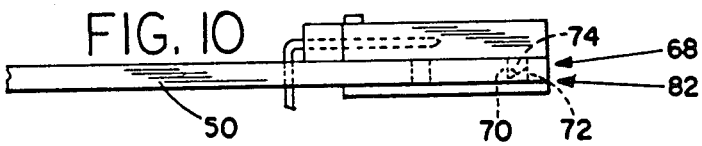
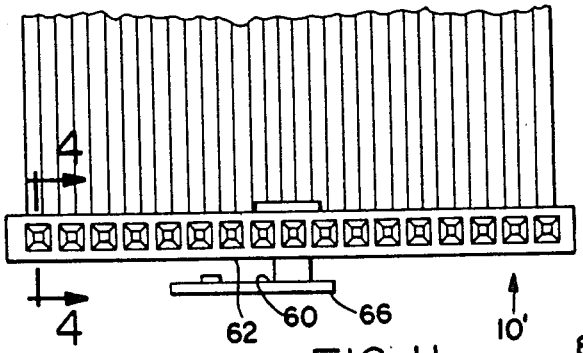
FIG. 11
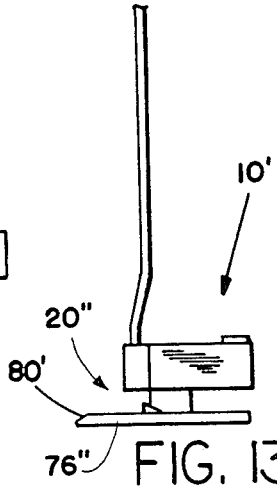
FIG. 13
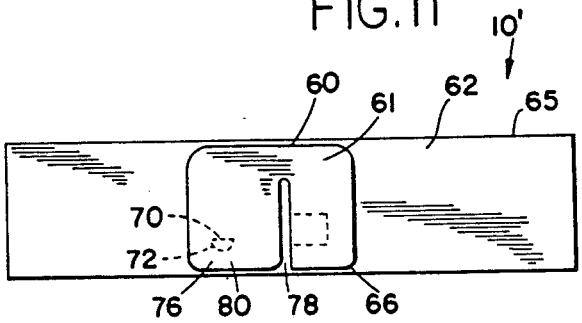
FIG. 12

ELECTRICAL CONNECTOR WITH KEYING, TORSION RESTRAINT AND LATCHING FEATURES

TECHNICAL FIELD

The present invention relates generally, as indicated, to electrical connectors and, more particularly, to connectors of cable termination assemblies and other electrical and electronic devices and parts intended for connection to contacts on another device in such a way that the electrical connector can be placed accurately, can become relatively securely latched in place, and avoids applying certain physical stresses and strains to such contacts and/or other connections thereof.

BACKGROUND

The use of printed circuit boards, both single sided and double sided, and similar devices in the electronics industry is well known. Often printed circuit traces on such boards are terminated at holes in the printed circuit board. For a single sided board, a trace typically is terminated at a connection or solder pad adjacent the hole, but usually there is no plating or metal in the hole itself. For a double sided board usually the trace is terminated at a plated through hole. Connection of a particular connector or electronic device is made with such traces by respective contacts or leads that are placed in such holes. The mechanical and electrical connections made at such holes often are secured by soldering the leads or contacts and the electrically conductive material at, proximate and/or in a respective hole.

One type of connector device used for connecting the traces on a printed circuit board with other circuitry or devices is known as a header. A header has a plurality of pin contacts or leads that are held in parallel spaced apart relation, generally electrically isolated from each other, by an electrically non-conductive body which usually provides both strain relief and electrical insulation functions. Exemplary spacing of such pin contacts may be on the order of about 0.010 inch, and this gives an idea of the relatively small size of the electrical connector of the present invention. On one side of the header body the head pin contacts are placed in the mentioned holes in the printed circuit board; and on the other side of such body, the header pin contacts are exposed for connection to another electrical connector, e.g. of a cable termination assembly or the like. Such exposed header pin contacts typically extend either normal to the printed circuit board surface or at another angle relative to such surface, including generally parallel thereto.

One problem encountered when connecting an electrical connector to header pin contacts that extend generally in parallel to the surface of a printed circuit board has been that torsional forces or stress applied to the solder connections at the aforementioned holes could weaken or break such connections. Such stress could be derived from the electrical connector as it is installed on or removed from such header pin contacts or even while such electrical connector is in place, for example, via a cable to which the electrical connector it is attached.

For single sided boards the solder connection usually is between the solder pads and the pin contacts. Since the holes adjacent the pads and in which the pin contacts are placed are not plated through, solder will not ordinarily flow into the holes. Adequate space is provided in the holes to permit insertion of the respective pin contacts therein before soldering. Thus, a torsion or rotating type force applied to the pin contacts may tend to rock the pins in the holes or otherwise to move the pin contacts and, thereby, break the solder connection. Such rocking could happen too easily especially when the header is of the type having the contacts extending parallel to the surface of the printed circuit board, during the installation of an electrical connector in connection with the header. Although the solder would tend to flow into plated through holes of a double sided printed circuit board to provide a stronger mechanical connection of a pin contact in that hole than would be obtained typically for single sided boards, it would be helpful to minimize stress applied to the pin contacts of such headers even for double sided boards.

Another difficulty encountered in the header pin contacts/electrical connection arrangements currently used is the assurance of proper alignment of the electrical connector with respect to the header pin contacts so that correct connections between the header pin contacts and corresponding contacts in the electrical connector will be made and so that damage due to misalignment or incorrect connection will be avoided.

Further, a difficulty encountered in several header pin contacts/electrical connection arrangements is the possibility that the electrical connector might disconnect from the header pin contacts, for example in the case of being subjected to vibrational forces. Such vibrational forces may occur in an automobile or other vehicle.

BRIEF SUMMARY OF THE INVENTION

According to the present invention, novel keying, torsion restraint and latching features are provided for an electrical connector for connection to plural contacts mounted on a printed circuit board or other support or the like. Importantly the various features of the invention may be embodied in a relatively small electrical connector useful in a variety of applications, such as automotive, telecommunications, computers, and so on.

According to one aspect of the invention, the latching feature is in the form of a resilient latching mechanism including a latching member mounted on a support that is readily deformable when force is applied thereto in a specific way; the latching member cooperates with a corresponding member that is associated, e.g. a part of, the printed circuit board.

According to another aspect, the anti-rotation or torsion restraint feature is in the form of a surface that slips beneath the printed circuit board surface opposite the printed circuit board surface at which a connector portion of the electrical connector is placed to make connections with the header pin contacts mounted on the printed circuit board, whereby a surface of the connector portion and the anti-rotation surface effectively sandwich the printed circuit board therebetween. The two parts, namely such connector portion, or more specifically a surface thereof confronting one surface of the printed circuit board, and the mentioned anti-rotation surface facing the other surface of the printed circuit board cooperate to assure linear, parallel, aligned installation movement of the electrical connector thereby to prevent application of torsional forces to the header.

The keying feature of the invention is in the form of a web or pillar between the aforementioned connector portion and the anti-rotation surface. Such web fits in a slot formed in the printed circuit board to assure correct placement of the electrical connector as it is slid onto the header pin contacts. Associated with the keying feature is a further stop key on a surface of the electrical connector body to prevent the electrical connector from being installed upside down on the header and printed circuit board.

The electrical connector of the present invention is capable of accurate placement with respect to the header pin contacts mentioned due to such keying feature, will hold relatively securely and can be removed with facility when specifically desired to do so, and avoids applying torsion forces to the header pin contacts.

In a preferred embodiment and best mode of the invention described in greater detail below, the electrical connector is referred to as including a housing or body at least part of which is molded of electrically non-conductive material and plural electrical contacts. The contacts are referred to as fork contacts, which are known and which often are characterized as female contacts; ordinarily female contacts require a housing to guide male pin type contacts into proper alignment, engagement and electrical connection with such female contacts. Such would be the case, in particular, when the electrical connector of the invention is used with a header that has pin contacts, as was mentioned above. However, it also will be appreciated that the invention may be used with male contacts in the electrical connector and female type contacts at the header or other device to which the electrical connector is intended to be connected. Furthermore, the invention envisions use of contacts other than those strictly known as female or male; for example, the invention may include use of bow or other shape contacts in either the header or in the electrical connector. Another type of female contact useful in the invention is a box contact. Additionally, although the invention is described for connection to a header type device which is mounted on a printed circuit board, it will be appreciated that the device to which the electrical connector of the invention is connectable may be other than a header and the surface or support with which the electrical connector is positioned, e.g. a printed circuit board, may be other than a printed circuit board.

The foregoing and following objects, advantages, aspects, features and accomplishments of the present invention will become more apparent from the following description with reference to the annexed drawings.

To the accomplishment of the foregoing and related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be employed.

BRIEF DESCRIPTION OF THE DRAWINGS

In the annexed drawings:

FIGS. 5, 6 and 8–10 are schematic illustrations showing the several stages during installation of the electrical connector with respect to the pin contacts of a male header mounted on a printed circuit board;

FIGS. 11 and 12 are, respectively, fragmentary front and bottom views of an alternate embodiment of electrical connector in accordance with the present invention, and FIG. 13 is a side view of a modified electrical connector according to the invention.

DESCRIPTION OF THE PREFERRED EMBODIMENT

Figure 1:
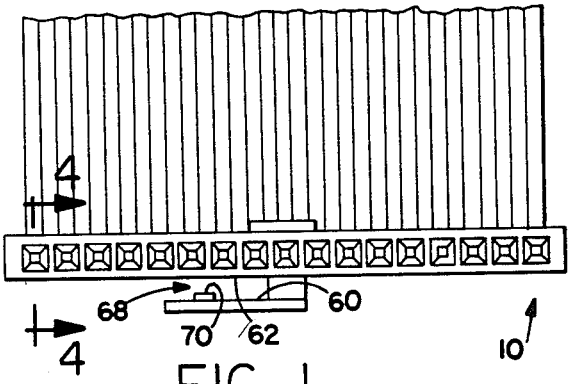
FIG. 1 is a front view of the electrical connector of the present invention.
Figure 2:
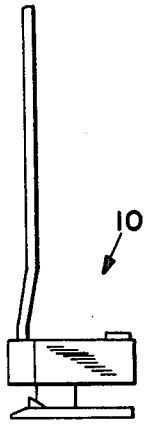
FIG. 2 is a side view of the electrical connector of FIG. 1.
Figure 3:
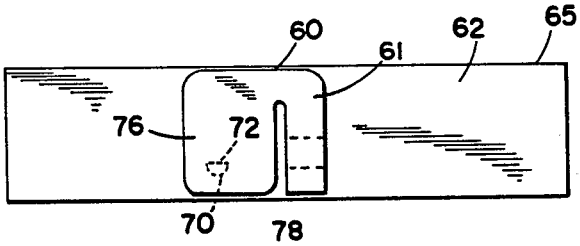
FIG. 3 is a view looking at the bottom of the electrical connector of FIG. 1.
Figure 4:
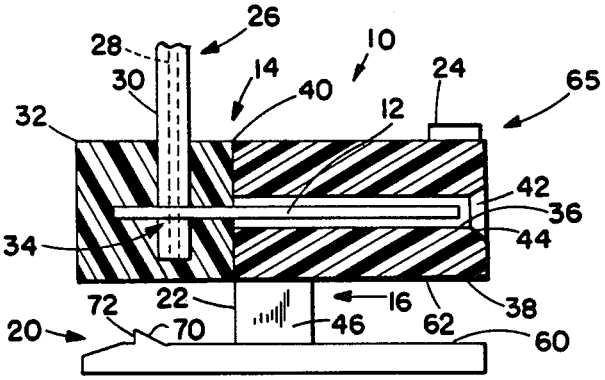
FIG. 4 is a section of the electrical connector looking generally in the direction of the arrows 4—4 of FIG. 1.

Referring, now, in detail to the drawings, wherein like reference numerals refer to like parts in the several figures and primed reference numerals refer to similar (but slightly modified) parts in the several figures, and initially to FIGS. 1–4, an electrical connector according to the present invention is designated 10. The electrical connector is in the form of a cable termination assembly, i.e. an electrical connector that terminates an electrical cable to couple the cable conductors with respect to other electrically conductive members such as pin contacts of a male header, traces on a printed circuit board, another cable and cable termination assembly, etc., as, of course, is well known. The features of the invention may be incorporated in other electrical connector devices, such as cable terminations, circuit board connectors, and the like. The following description, though, is directed to the preferred embodiment and best mode of the invention in the form of an electrical connector as a cable termination assembly.

The fundamental components of the electrical connector 10 include a plurality of electrical contacts 12, a connector body 14 for supporting the contacts, a keying mechanism 16, an anti-torsion or anti-rotation mechanism 18, and a latching mechanism 20. Preferably the keying mechanism includes both an alignment key 22 and a stop key 24, as are described further below. The electrical connector 10 is shown in the form of a cable termination assembly, which includes a multiconductor ribbon type electrical cable 26 with plural conductors 28 in an insulation jacket 30. The invention may be used with other types of cables or discrete wires/conductors, too.

According to the preferred embodiment, the electrical contacts 12 are fork contacts, each of which has a pair of tines at one end to connect with a pin contact inserted into electrical and mechanical engagement therewith and each of which has an insulation displacement connection end intended to effect insulation displacement connection with a respective conductor 28 of the cable 26. Moreover, the contacts 12 are spaced apart from each other aligned in one or more parallel rows; the embodiment shown has only a single row for illustrative purposes. The connector body 14 is formed of a molded body portion 32, which is of electrically non-conductive material that is molded directly to part of the contacts 12 and cable 26, including the junctions 34 of the contacts 12 and conductors 28, to form an integral structure or assembly thereof.

Reference is made here to Venaleck U.S. Pat. No. 4,030,799, which discloses an electrical connector cable termination with plural electrical fork contacts that undergo insulation displacement connection with respective conductors of a multiconductor ribbon type electrical cable and a molded body that secures the cable and contacts in positional relation to each other as an integral assembly. The electrical connector of the present invention may be made using the techniques disclosed in such U.S. Pat. No. 4,030,799, including, for example, the insulation displacement connection of the contacts 12 and cable 26 and the molded body portion 32. Accordingly, the entire disclosure of such patent hereby is incorporated by reference.

As is disclosed in such U.S. Pat. No. 4,030,799 and as is represented at 36 in FIGS. 1 and 4 of the drawings hereof, each of the fork contacts 12 preferably is located in a respective cell or chamber 36 formed within a cover or housing 38. The cover 38 may be a part that is molded of electrically non-conductive material separately from the body portion 32. The cover 38 is attached to the body portion 32, for example, by ultrasonic welding, adhesive material, etc., at a connection 40. Respective openings 42 provide access into respective chambers 36 preferably with tapered walls 44 providing a lead into guide pin contacts properly into aligned connection with respective female fork contacts.

The alignment key 22 of the keying mechanism 16 is in the form of a web or pillar 46 that extends down from the bottom of the cover 38. Reference to direction herein is relative to the drawings for convenience but does not necessarily require that parts physically extend down, up or otherwise during actual positioning or use of the electrical connector 10 of the invention.

Referring preliminarily to FIGS. 5–10, the pillar 46 cooperates with an edge 48 of a printed circuit board 50 to block insertion or installation of the electrical connector 10 with respect to the pin contacts 52 of a male header 54 mounted on the printed circuit board 50 unless and until the pillar is aligned with and sliding within a slot 56 formed in the printed circuit board. Such slot 56 is open at the edge 48 to permit the pillar to enter the slot. Moreover, preferably the pillar has a width about the same as the width of the slot 56 (with adequate space to permit relatively easy sliding in the slot) and a length such that the pillar cooperates with the side walls of the slot to help assure that the electrical connector is inserted generally in a linear direction toward and aligned with the male header 54 for proper connection of the contacts 12 and 52. Thus, it will be appreciated that the pillar 46 cooperates with the edge 48 and the slot 56 of the printed circuit board 50 or other support to assure that the electrical connector 10 is aligned properly with respect to the pin contacts of the male header for proper installation thereon and connection therewith before actual installation on the pin contacts is effected.

Another part of the keying mechanism 16, which helps to prevent incorrect installation of the electrical connector 10 on the male header 54, is a stop key 24. The stop key 24 is in the form of a raised surface impediment on the top of the cover 38 of the electrical connector 10. The width of such raised surface of the stop key 24 preferably is wider than the width of the slot 56 in the printed circuit board 50 so that the stop key would not fit in the slot 56. The height of the stop key preferably is adequate to raise the openings 42 to the chambers 36 in the electrical connector 10 out of alignment with the pin contacts 52 of the male header 54 to preclude upside down installation of the electrical connector 10 on such pin contacts.

The anti-torsion or anti-rotation mechanism 18 of the electrical connector 10 includes a surface 60, which is supported from the pillar 46 by a support 61 and cooperates with the bottom surface 62 of the body portion 32 and cover 38 to sandwich the printed circuit board 50 therebetween. Such surfaces 60, 62 cooperate with the top and bottom surfaces 63, 64, respectively of the printed circuit board 50 to prevent rotation of the electrical connector 10 in particular during sliding thereof with the pillar 46 in the slot 56. Thus, during installation or removal of the electrical connector 10, such anti-rotation mechanism 18 tends to require the electrical connector to be moved generally in parallel to the surfaces 63, 64 of the printed circuit board or other support parallel to which the pin contacts 52 of the male header 54 are extending.

It will be appreciated that the location of the surface 60 may be, as shown, in front of or leading the the pillar 46 of the keying mechanism 16 to assure correct orientation of the electrical connector 10 with respect to the printed circuit board 50 and the male header pin contacts 52 prior to the pillar 46 entering the slot 56. Such trailing of the pillar 46 relative to the leading part of the surface 60 also permits printed circuit traces to be located on the printed circuit board beneath the leading or front portion 65 of the electrical connector 10, i.e. beneath the portions of the pin contacts 52 that extend horizontally or in parallel over the printed circuit board, because the slot 56 does not have to protrude so far into the printed circuit board. If desired, though, the pillar may be located further toward the front 65 of the electrical connector, e.g. more proximate or even at the surface 60. Although the anti-rotation mechanism is described here as forcing parallel movement of the electrical connector 10 with respect to the printed circuit board 50, it will be appeciated that the essence of this anti-rotation mechanism is the forcing of the electrical connector to move in a prescribed direction and that prescribed direction preferably is in parallel to the pin contacts to which the electrical connector is intended to be installed or removed.

The stiffness of the material forming the extension of the support 61 of which the surface 60 is a part preferably is adequate to preclude bending or at least substantial bending during the aforementioned installation or removal of the electrical connector 10. However, referring briefly to FIGS. 11 and 12, in which a modified electrical connector 10' is illustrated, if desired for additional anti-rotation function, an additional surface or flange-like portion 66 may be provided as part of the anti-rotation mechanism 18 to increase further the sandwiching and rotation prevention functions of the electrical connector. It will be evident from the illustration in FIGS. 11 and 12 that the surface 66 effectively enlarges the surface area cooperative with the bottom surface 62 of the cover 38 and body portion 32 between which the printed circuit board is sandwiched or trapped.

It will be appreciated, too, that the pillar 46 may cooperate with the side walls of the slot 56 to prevent rotation of the electrical connector 10 during insertion into the slot, thus adding a further anti-rotation feature of the invention while the surfaces 60, 62 prevent rotation about a different axis. Thus, the invention may provide anti-rotation and, thus, anti-torsion relative to two axes further to avoid damage to the connections of the header pin contacts to the printed circuit board 50. This anti-torsion feature is further enhanced using the additional surface 66 illustrated in FIG. 12.

As is seen in the drawings, the latching mechanism 20 includes a multi-part, e.g. two part, detent arrangement 68, one part of which is part of the electrical connector 10 and the other part of which is part of the printed circuit board 50. According to the preferred embodiment, the one part of the detent arrangement 68 which is part of the electrical connector is a protruding member in the form of a ramp surface 70 and a detent or stop surface 72; and the other part of the detent arrangement 68 is a hole or opening 74 formed in the circuit board 50. The hole 74 may be fully through the printed circuit board or it may be only a recess in the printed circuit board to provide insertion of the ramp surface therein and interference of the stop surface 72 with a wall of the hole to resist removal of the electrical connector from the installed position, as is seen most clearly in FIG. 10, for example.

The ramp 70 and stop surface 72 are located on a flexible tab member 76 that ultimately is supported from the pillar 46. Thus, in a sense, the ramp surface 70 and stop surface 72 are supported by the flexible tab in cantilever relation to permit latching of the electrical connector 10 with respect to a printed circuuit board or the like and/or to facilitate controlled release of the latching mechanism for removal of the electrical connector 10, when desired. At the leading end of the tab 76 is the surface 60 and the support extension thereof which leads back to the pillar 46. From the surface 60 back to the trailing end of the electrical connector 10 is a slot 78 that separates the tab 76 from the pillary 46 and from the support 61. The actual length of the slot 78, more particularly, the length of surface 60 in the direction of the slot 78, i.e. from front to back of the electrical connector, may be determined as a function of the desired strength, stiffness or flexibility characteristics of the tab 76. The longer the dimension of the support 61 and surface 60 in the direction of the slot 78, of course, ordinarily the stronger or stiffer and the more difficult it would be to bend the tab 76.

The two parts of the detent arrangement 68 may be reversed, if desired. For example, the ramp and stop surface may be part of the printed circuit board while the hole is part of the electrical connector. Moreover, if desired, the parts of the detent arrangement may be other than the illustrated ramp/stop surface combination as one part and hole as the other part; for example, the stop surface may simply be a protrusion without a gradual ramp slope thereto; also, the hole may be replaced by another protrusion that provides a surface against which the stop surface 72 may engage. However, such alternate possibilites are not believed as desirable as the illustrated preferred ramp/stop surface and recess combination.

An advantage of the ramp 70, stop surface 72, and hole 74 latching mechanism 20 is that during installation of the electrical connector 10, the flexible tab 76 bends as the ramp slides against the underside of the printed circuit board 50 and upon completing the installation, the ramp snaps or moves into the hole 74 to signal such completion to the installer. Another advantage of the ramp, stop surface and hole latching mechanism is that it is in a sense a passive system because no separate operation must be effected to cause latching other than proper installation of the electrical connector 10 on the pin contacts of the header. An advantage to having the flexible tab 76 support the ramp and stop surface of the latching mechanism 20 (or in any event the part of the latching mechanism which is carried on or is part of the electrical connector 10) separately from the body portion 32 or the housing 38 is that the latching mechanism will work independently of the body portion and housing and will not affect alignment thereof with the pin contacts of the header. Thus, the latching mechanism 20 in a sense is independent of the fixed side of the electrical connector 10 which directly connects with the header on the opposite side of the printed circuit board from the ramp surface 70 and stop surface 72.

To release the latching mechanism 20, external force may be applied to the back end 80 of the flexible tab 76 to pry it and the stop surface 72 away from the engagement in the hole 74. To facilitate using a tool, such as a screw driver, to release the latching mechanism 20, the back end 80 may be tapered to provide a space 82 seen in FIG. 10 beneath the printed circuit board 50 for insertion of the tool and prying using the mechanical advantage of the tool lever arm.

Briefly referring to FIG. 13, a modified electrical connector 10″ is shown. The electrical connector 10″ generally is like the electrical connector 10 or like the electrical connector 10′ described above; however, in the electrical connector 10″ there is a modified latching mechanism 20″. Specifically, in the electrical connector 10″ the flexible tab 76″ is longer than the flexible tabs 76 described above so that an extended back end 80″ thereof can be manipulated manually rather easily to bend the tab to release the ramp/stop surface 70, 72 from the hole 74 preferably without the need for a separate tool. Since the latching mechanism 20 has a smaller external profile, i.e. it does not extend beyond the back end of the electrical connector body portion 32, than does the latching mechanism 20″, the amount of space beyond the printed circuit board 50, for example, required by the electrical connector 10 is less than that required by the electrical connector 10″ and it is more difficult to remove the electrical connector 10 from the printed circuit board 50 than it is to remove the electrical connector 10″.

Operation and installation of the electrical connector 10, 10′ and 10″ has been alluded to above and now will be described in detail with reference to several features of the invention using the electrical connector 10 as an example. The several stages of the installation process are illustrated in FIGS. 5–10. The electrical connector 10 is intended for installation by way of connection to the pin contacts 52 of a male header 54 which is mounted on a printed circuit board 50. The pin contacts 52 extend in parallel spaced apart relation to the surface 64 of the printed circuit board.

Figure 7:
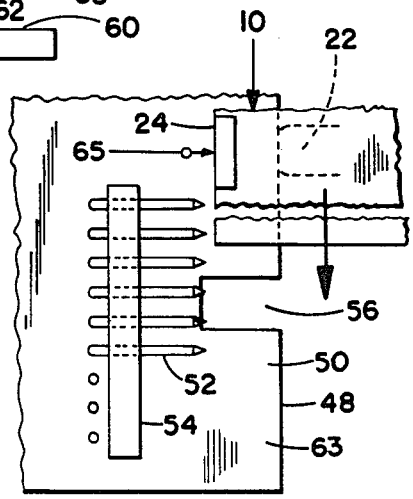
FIG. 7 is a plan view of the electrical connector before installation being positioned with respect to the pin contacts of the male header mounted on a printed circuit board.

As is seen in FIG. 5, the electrical connector 10 is aligned with respect to the edge 48 of the printed circuit board 50 in order to slip the electrical connector onto the board sandwiching the board between the surfaces 60, 62 of the electrical connector. In FIG. 6 the electrical connector 10 has been placed onto the edge of the printed circuit board and sliding thereof toward the pin contacts 52 has commenced; alignment of the pillar 46 of the keying mechanism 16 with respect to the slot 56 has not necessarily been accomplished in the FIG. 6 illustration. Indeed, as is shown in FIG. 7, the electrical connector 10 may be slid along the edge 48 with the leading edge of the pillar 46 engaged with such edge 48 and the surfaces 60, 62 providing the sandwiching of the printed circuit board 50 within the electrical connector. As is seen in FIG. 7, the positions and dimensions of the leading edge of the pillar 46, the edge 48, the front 65 of the electrical connector 10 and the ends of the pin contacts 52 are related so that during such sliding along the edge 48 the front 65 remains spaced away from the ends of the pin contacts to avoid damaging them and to avoid inadvertent misaligned and incorrect partial connections being made.

During the sliding of the electrical connector 10 along the edge 48 of the printed circuit board 50, the surfaces 60, 62 cooperate with the top and bottom surfaces 63, 64 of the printed circuit board to assure that the electrical connector will be maintained in a prescribed orientation, preferably with the surfaces 60, 62 parallel to the top and bottom surfaces of the printed circuit board. Therefore, alignment of the front end 65 of the electrical connector as well as of the openings 42 therein and of the contacts 12 in the plane of the pin contacts 52 is assured. Eventually, as the electrical connector 10 is slid along the edge 48, the pillar 46 will align with and enter the slot 56 at which point the electrical connector can be moved toward the pin contacts 52 to connect therewith. The electrical connector 10 is moved in the slot 56, which provides a polarizing function to prevent alignment of the pin contacts 52 with the incorrect holes 42 and contacts 12, toward the header 54 to accept within the openings 42 the leading ends of the correct pin contacts 52, as is shown in FIG. 8, and the ramp surface 70 of the latching mechanism 20 begins to engage the bottom surface 64 of the printed circuit board.

Further insertion of the electrical connector 10 toward the insulation body of the header 54 causes the pin contacts 52 and the fork contacts 12 respectively to achieve full paired connection. Also, as is seen in FIG. 9, the flexible tab 76 tends to deflect under the force of the interference of the ramp 70 with the bottom surface 64 of the printed circuit board. When the electrical connector 10 has been fully installed on the pin contacts 52 of the header 54, the ramp 70 and stop surface 72 snap into the hole 74, as is illustrated in FIG. 10. In such fully installed position relative to the header 54, the front surface 82 of the electrical connector 10 preferably engages the body of the header 54 before the leading edge of the pillar 46 engages the end wall of the slot 56. Such relationship assures full installation of the electrical connector 10 with respect to the header 54 without having to rely on the accuracy of the length dimension of the slot 56.

It will be appreciated that during the above described installation procedure, the electrical connector 10 is maintained in the desired orientation with respect to the pin contacts 52, namely parallel with respect to the pin contacts and to the printed circuit board. Therefore, the possibility that the electrical connector 10 would apply excessive torquing or torsion force tending to push the pin contacts in the holes in which they are mounted in the printed circuit board is avoided. As was mentioned above, such a torsion force could tend to weaken the solder connections of the pin contacts to the traces on the printed circuit board. Moreover, the latching mechanism 20 retains the electrical connector 10 on the printed circuit board 50 in connection with the header 54 until the stop surface 72 is released from the hole 74 and the electrical connector 10 is removed to an extent that pulls the ramp 70 out of the hole 74. Moreover, upon any removal of the electrical connector 10 from connection with the header 54, the pillar 46 and slot 56 of the keying mechanism 16 cooperate to assure that the electrical connector is pulled straight away without twisting; and the surfaces 60, 62 continue to maintain the sandwiched relation of the printed circuit board therebetween to prevent application of undesired torsion forces to the header pin contacts.

It will be appreciated that the various features of the invention may be used as the electrical connector 10 is connected or installed with respect to another type of electrical connector other than a header and the contacts of the connector to which the electrical connector 10 is intended for connection may be parallel or otherwise oriented with respect to a printed circuit board or other support structure. As one example, the connector to which the electrical connector 10 is to be connected may be a male header with pin contacts extending perpendicular to the surface of a printed circuit board, such as board 50, and there may be provided another printed circuit board or other support type member that extends generally parallel with such pin contacts to provide an anchor or latching surface, e.g. with a hole 74 therein, and to provide correct alignment and guidance of the electrical connector 10, e.g. by including an appropriate slot 56 and edge 48, to assure properly aligned connection with respect to such header. This is but one example of alternative uses of the electrical connector 10 of the present invention. It also will be appreciated that the several features of the invention shown with one or another embodiment hereof may be used with the various other embodiments and with other electrical connectors that fall within the context of the invention. The scope of the invention, of course, constituting equivalents of the above-described and following claimed electrical connectors and the like.

TECHNICAL FIELD

In view of the foregoing, it will be appreciated that the electrical connector of the present invention may be used to effect connection of one or more electrical conductors, circuits or the like with respect to one or more other electrical connectors, conductors, circuits or the like.

I claim:

1. An electrical connector comprising plural electrical contacts, body means for supporting said contacts in fixed geometrical relationship to each other for electrical connection to respective external electrically conducting members disposed adjacent a first side of a circuit board having opposed first and second sides by mechanism engagement of said contacts and the members, a resilient cantilever tab, means for mounting said cantilever tab in spaced relationship to said body means for disposition adjacent and generally parallel to the second side of the board, and latching means for latching said electrical connector to the board, said latching means including detent means on said resilient cantilever tab for engaging the board to retain said electrical connector with respect to the board.

2. A connector as set forth in claim 1, wherein said detent means comprises ramp surface means engagable by the board during installation of said electrical connector with respect to the board for effecting deflection of said detent means, and stop surface means for interference engagement with the board.

3. A connector as set forth in claim 2, in combination with said board and external members.

4. A connector as set forth in claim 1, in combination with said board and external members.

5. A connector as set forth in claim 1, comprising anti-torsion means for minimizing application of torsional force to the external members during installation of said electrical connector with respect to the circuit board, said anti-torsion means comprising pillar means extending outwardly from said body means and first surface means attached to said pillar means and spaced from said body means for defining an insertion space for the circuit board between said first surface means and body means and for engaging the second side of the circuit board when inserted between said first surface means and said body means, and said body means including second surface means for engaging the first side of the circuit board.

6. A connector as set forth in claim 5, wherein said first surface means includes said resilient cantilever tab and said pillar means includes said means for mounting said cantilever tab.

7. A connector as set forth in claim 6, in combination with said board and external members.

8. A connector as set forth in claim 6, wherein said detent means comprises ramp surface means engagable by the board during installation of said electrical connector with respect to the board for effecting deflection of said detent means, and stop surface means for interference engagement with the board.

9. A connector as set forth in claim 8, in combination with said board and external members.

10. A connector as set forth in claim 5, in combination with said board and external members.

11. An electrical connector comprising plural electrical contacts, body means for supporting said contacts in fixed geometrical relationship to each other for electrical connection to respective external electrically conducting members disposed adjacent a first side of a circuit board having opposed first and seond sides by mechanical engagement of said contacts and the members, said body means having opposite lateral ends, and anti-torsion means for minimizing application of torsional force to the external members during installation of the electrical connector with respect to the circuit board, said anti-torsion means including pillar means extending outwardly from said body means and first surface means attached to said pillar means and spaced from said body means by said pillar means for defining an insertion space for the circuit board between said first surface means and body means and for engaging the second side of the circuit board when inserted between said first surface means and said body means, said body means including second surface means for engaging the first side of the circuit board, and said pillar means being joined to said body means at a location laterally spaced from said ends of said body means and having laterally opposite side surfaces extending between said first surface means and said second surface means, said side surfaces being laterally inwardly offset from respective laterally outermost ones of said contacts.

12. A connector as set forth in claim 11, wherein said first and second surface means are cooperative to guide said electrical connector generally in parallel relation with respect to the circuit board.

13. A connector as set forth in claim 11, comprising keying means protruding from said body means for sliding into a slot formed in and open to an edge of the circuit board to assure proper alignment of said connector with respect to the external members prior to engagement of the external members and said contacts.

14. A connector as set forth in claim 13, in combination with said circuit board and external members.

15. A connector as set forth in claim 13, wherein said pillar means comprises a pillar forming said keying means, said pillar extending between said body means and said first surface means.

16. A connector as set forth in claim 15, comprising stop key means on a surface of said body means for preventing said electrical connector from being installed upside down with respect to the board.

17. A connector as set forth in claim 11, wherein at least a part of said body means is molded as an integral structure supporting said contacts.

18. A connector as set forth in claim 11, wherein said body means includes a housing having opening means for permitting insertion of a plurality of the external members into said housing for electrical connection with said contacts.

19. A connector as set forth in claim 11, in combination with a multiconductor cable, said contacts being engaged with respective conductors of said cable, and said body means at least in part molded about at least a part of said cable and said contacts to form an integral structure therewith.

20. A connector as set forth in claim 11, in combination with said circuit board and external members.

21. A connector as set forth in claim 11, wherein said pillar means has a width substantially less than the width of said body means.

22. A connector as set forth in claim 11, in combination with said circuit board, said circuit board having a slot formed in and opening to an edge of said circuit board, and said side surfaces of said pillar means coacting with side walls of said slot to prevent rotation of the connector about an axis perpendicular to said circuit board.

23. A connector as set forth in claim 11, wherein said pillar means is located about midway between said lateral ends of said body means.

* * * * *